US007959188B2

(12) United States Patent
Martineck, Sr.

(10) Patent No.: US 7,959,188 B2
(45) Date of Patent: Jun. 14, 2011

(54) LOTTERY TICKET HAVING MATCHED INDICIA GRID WITH ROW AND COLUMN WIN INDICATORS

(75) Inventor: Jeffrey D. Martineck, Sr., Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 951 days.

(21) Appl. No.: 11/894,226

(22) Filed: Aug. 20, 2007

(65) Prior Publication Data

US 2008/0042426 A1 Feb. 21, 2008

Related U.S. Application Data

(60) Provisional application No. 60/839,146, filed on Aug. 21, 2006.

(51) Int. Cl.
*B42D 15/00* (2006.01)
*A63F 1/18* (2006.01)
*A63F 3/06* (2006.01)

(52) U.S. Cl. ..... 283/903; 283/100; 283/102; 273/269; 273/139

(58) Field of Classification Search ..... 283/72, 283/94, 102, 49, 903; 273/139, 269
See application file for complete search history.

(56) References Cited

U.S. PATENT DOCUMENTS

| | | | | | |
|---|---|---|---|---|---|
| 4,775,155 | A * | 10/1988 | Lees | 273/139 |
| 5,074,566 | A * | 12/1991 | Desbiens | 273/269 |
| 5,386,985 | A * | 2/1995 | Paris | 273/269 |
| 5,624,119 | A * | 4/1997 | Leake | 273/269 |
| 5,657,991 | A * | 8/1997 | Camarato | 273/269 |
| 6,241,246 | B1 | 6/2001 | Guttin et al. | |
| 2003/0173739 | A1 * | 9/2003 | Stewart | 273/269 |
| 2004/0178579 | A1 * | 9/2004 | Lowell et al. | 273/269 |

OTHER PUBLICATIONS

International Search Report and Written Opinion for PCT/US2007/076373; May 16, 2008.

* cited by examiner

*Primary Examiner* — Dana Ross
*Assistant Examiner* — Kyle Grabowski
(74) *Attorney, Agent, or Firm* — Dority & Manning, P.A.

(57) ABSTRACT

A scratch off lottery game card is that includes a substrate on which a plurality of game indicia printed on a game indicia area in an M×N matrix and a plurality of player indicia printed on a player indicia area. The game indicia are preferably grouped by different identifier. If the game identified by an identifier have matched to the player indicia, the player wins a prize.

6 Claims, 4 Drawing Sheets

LOTTERY TICKET HAVING MATCHED INDICIA GRID WITH ROW AND COLUMN WIN INDICATORS

PRIORITY CLAIM

Applicant claims the benefit of prior filed provisional application No. 60/839,146 having a filing date of Aug. 21, 2006 and entitled "LOTTERY TICKET HAVING MATCHED INDICIA GRID WITH ROW AND COLUMN WIN INDICATORS."

BACKGROUND OF THE INVENTION

A typical scratch-off game card emulating a bingo game has a game area with a plurality of pre-printed game numbers (game indicia) and a player area with some pre-assigned player numbers (player indicia). There are a few pre-assigned patterns in the game indicia of the scratch-off game card. If the player indicia match the game indicia in one of the pre-assigned patterns, the player wins a prize associated with that pre-assigned pattern. Generally, the pre-assigned patterns are limited and straightforward with matching of a single full column or row being a win, and thus the game offers a limited number of winning possibilities.

A scratch-off lottery game card that provides multiple winning opportunities is desired and within the scope of the present invention.

SUMMARY OF THE INVENTION

Objects and advantages of the invention will be set forth in part in the following description, or may be obvious from the description, or may be learned through practice of the invention.

In one embodiment, there is provided a scratch-off lottery game card on which a plurality of game indicia are printed in an M×N matrix format and a plurality of player indicia are provided in a player indicia area. The game indicia in one column preferably have a different color from the game indicia in adjacent columns. The player indicia are preferably divided into two groups, each group being identified by a color. The player indicia of one color are used to match the game indicia of the same color. When the game indicia matched by the player indicia forms a pre-defined pattern within the matrix, the player wins a prize associated with the pre-defined pattern.

In another exemplary embodiment, a lottery game card is provided having a top, bottom, left, and right. The card includes a substrate having a player indicia area located upon the substrate. The player indicia area includes a plurality of player indicia. Preferably, the player indicia are concealed under a removable coating applied to the substrate. A game indicia area is also located upon the substrate. The game indicia area has a plurality of game indicia that are arranged into a matrix of columns and rows. At least one column having a column prize indicia is identified on the substrate. The column prize indicia identifies a prize to be won by a player matching all game indicia in the at least one column with player indicia from the player indicia area. In certain embodiments, at least one of the rows has a row prize indicia identified on the substrate. The row prize indicia identifies a prize to be won by a player matching all or a predetermined portion of game indicia along the at least one row with player indicia. For example, the row prize indicia may identify a prize to be won by a player matching game indicia of alternating columns along the at least one row with the player indicia. The columns may also be constructed to include game indicia having colors that alternate along the rows. The play card may also include a bonus indicia area located upon the substrate where the bonus indicia area includes a plurality of bonus indicia that may be matched with game indicia. In another variation of the present invention, each of the columns has a column prize indicia identified on the substrate with a respective column, and each such column prize indicia identifies a prize to be won by a player matching all the game indicia in a respective column with player indicia. In addition, each row may have a plurality of row prize indicia identified on the substrate with each of the respective rows. The plurality of row prize indicia identify prizes to be won by a player matching predetermined patterns of the game indicia along the at least one row with the player indicia.

In still another exemplary embodiment, the present invention provides a game card that includes a substrate and a plurality of player indicia located upon the substrate. A plurality of game indicia are also located upon the substrate and organized into a matrix comprising columns and rows of game indicia. A plurality of column prize indicia are provided and are located at an end of each respective column. A plurality of row prize indicia are located at an end of each respective row.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION

Reference will now be made in detail to embodiments of the invention, one or more examples of which are illustrated in the figures. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

Figure 1:
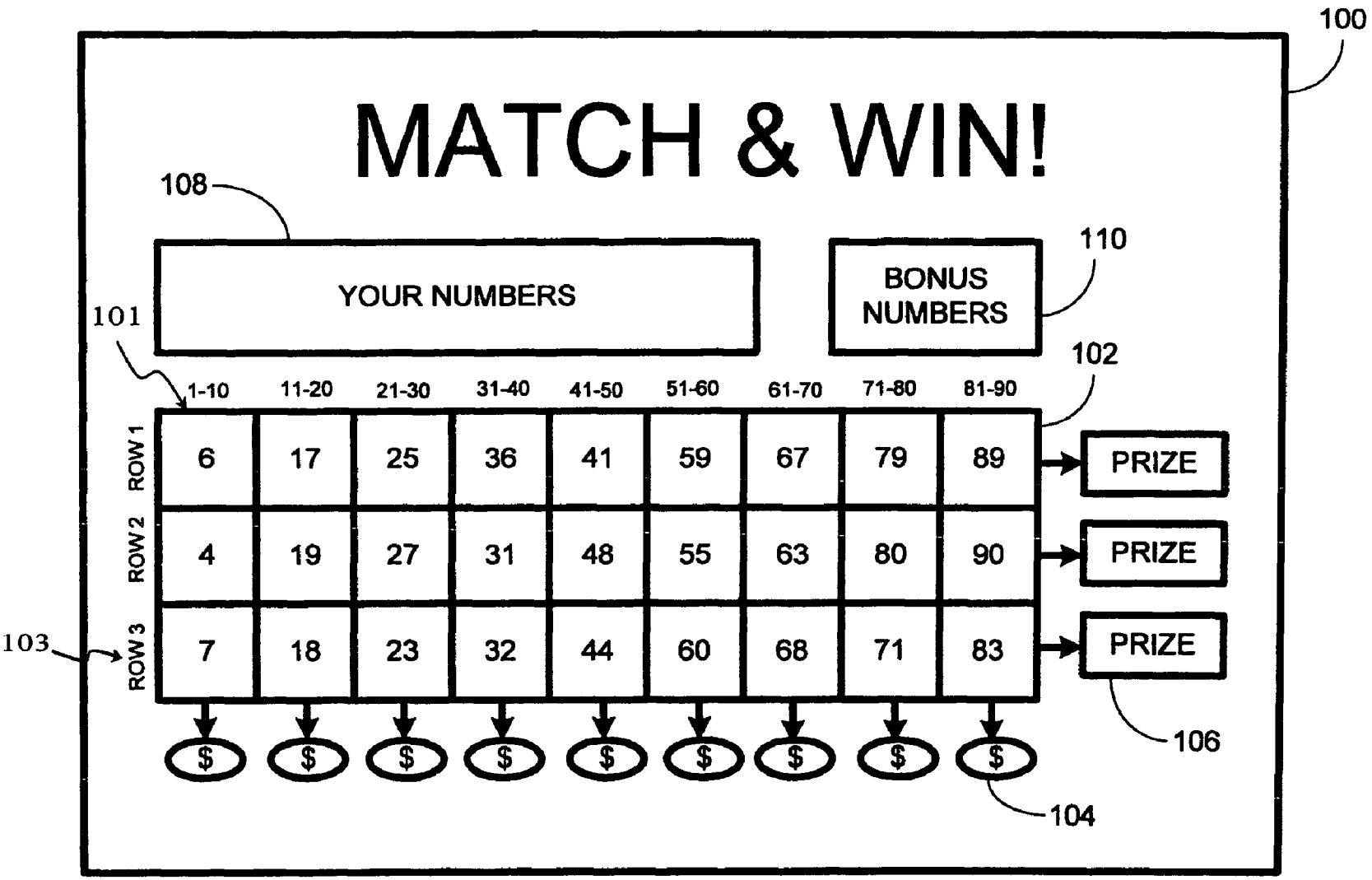
FIG. 1 illustrates a scratch-off game card according to one embodiment of the invention.

Briefly described, in one embodiment the invention is a lottery game card in which a set of predefined game indicia in an M×N matrix format (e.g., row and column) is printed in a game indicia area, and a set of predefined player indicia is printed in a player indicia area. A player may win a prize if the revealed player indicia match the game indicia in either a column or a row. In one exemplary embodiment as illustrated by FIG. 1, a game card 100 includes a plurality of game indicia printed in a game indicia area 102 and arranged in a matrix format. Each column 101 is associated with a prize 104 and each row 103 is also associated with a prize 106. The game card 100 also includes a plurality of player indicia printed in a player indicia area 108 and a few numbers of bonus indicia printed in a bonus indicia area 110. Both the player indicia and bonus indicia are initially covered by a removable material, such as a latex layer or other type of scratch off material.

To facilitate finding corresponding game indicia in the game indicia area each column 101 is labeled with a number range. The left most column 101 is labeled "1-10," which means that the game indicia numbered between 1 and 10 can be found in this column. To increase the chance of winning, the bonus indicia are provided. The player can also mark the game indicia that correspond to these bonus indicia. If the result of marking the game indicia corresponding to the bonus indicia matches a predefined pattern, the player wins a prize associated with that pattern.

Figure 2:
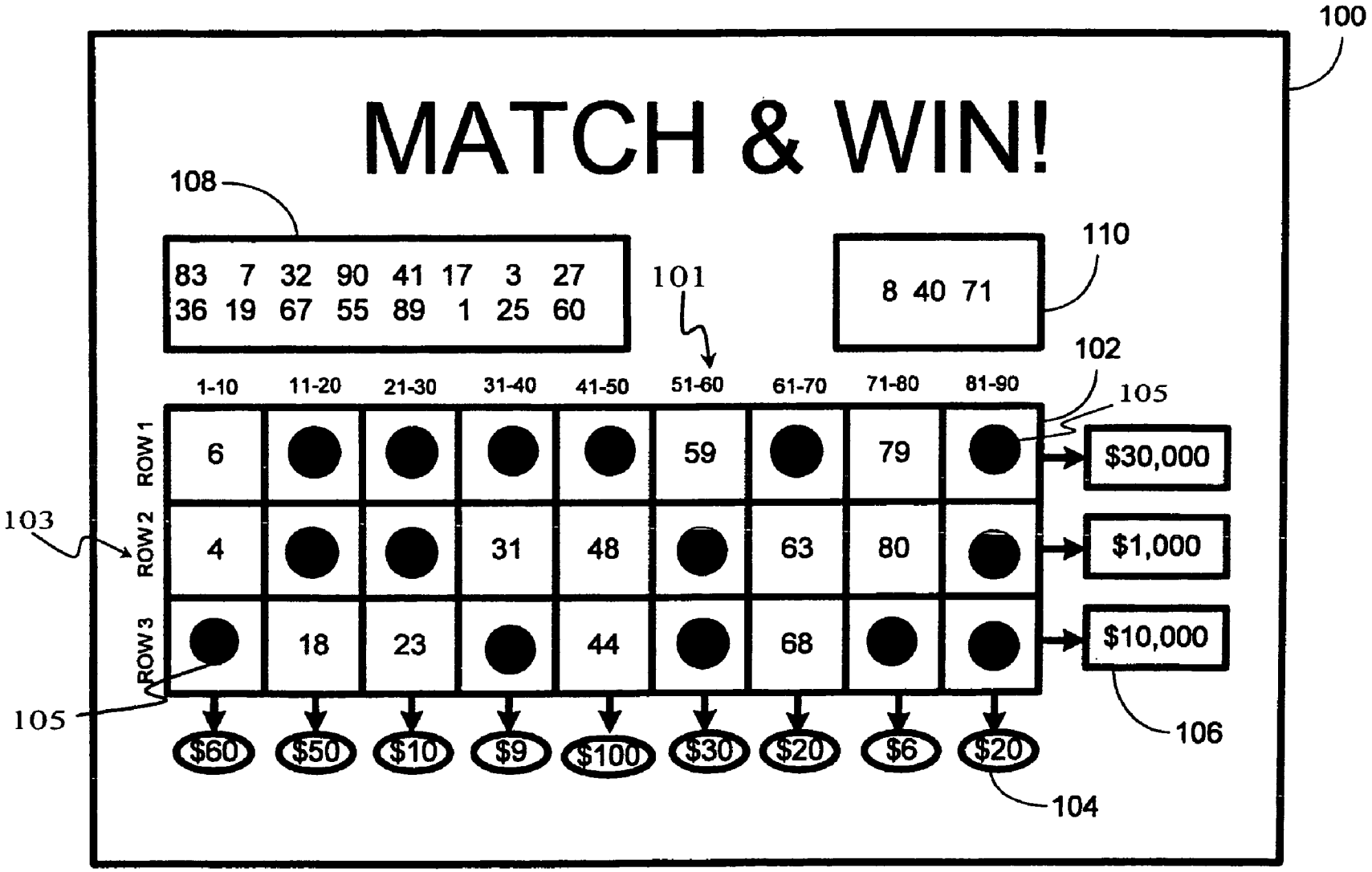
FIG. 2 illustrates the scratch-off game card of FIG. 1 with game indicia and player indicia revealed.

FIG. 2 illustrates the game card 100 of FIG. 1 with the player indicia 108 and bonus indicia 110 revealed. The game indicia that match player indicia are marked with circles 105. Circles 105 may have one or more colors and may be transparent or translucent. The game indicia, such as indicia 71, that match bonus indicia are also marked with a circle 105. It can be seen that the right-most column 105 has all three game indicia highlighted, and the player wins the prize, $20 (appears at the bottom of the column), associated with that column. As such, each column 101 presents an additional opportunity for a win.

Figure 3:
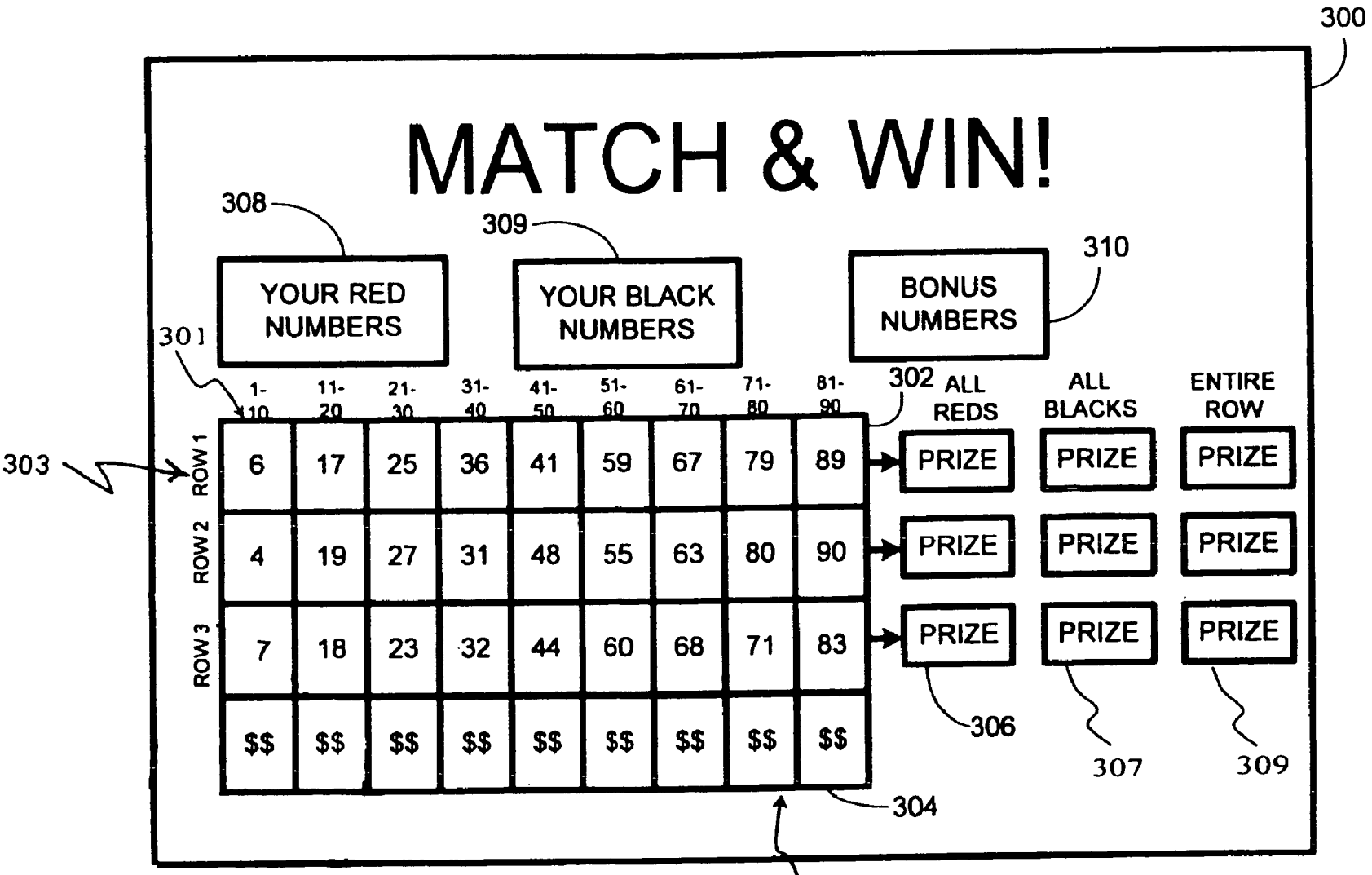
FIG. 3 illustrates a scratch-off game card according to an alternative embodiment of the invention.

FIG. 3 illustrates a game card 300 according to another exemplary embodiment of the present invention. For game card 300, the game indicia are separated into two groups, each group identified by a color. More specifically, the game indicia in one column 301 have one color that is different from the game indicia in adjacent columns. For example, the game indicia in the second column 301 labeled as "11-20" are of red color and the game indicia in the neighboring columns are of black color (other alternating color choices may be used as well). The player indicia are also grouped into two colors, one group 308 has red color and another group 309 has a black color. Additional winning opportunities are also introduced in this game card 300. The player could win a prize if the player indicia match all game indicia of one color on one single row. For example, if all red game indicia of the row 303 labeled as "Row 1" are matched by the player indicia, then the player wins a prize 306 identified at the end of "Row 1." Similarly, if all black game indicia of row 303 labeled as "Row 1" are matched by the player indicia, then the player wins another prize 307 identified at the end of "Row 1." If all the game indicia in one row are matched by the player indicia, then the player wins a bigger prize 309 identified at the end of "Row 1." As can be seen in FIG. 2, each row 303 is labeled and each has associated prizes for matching all reds, all blacks, or both.

Figure 4:
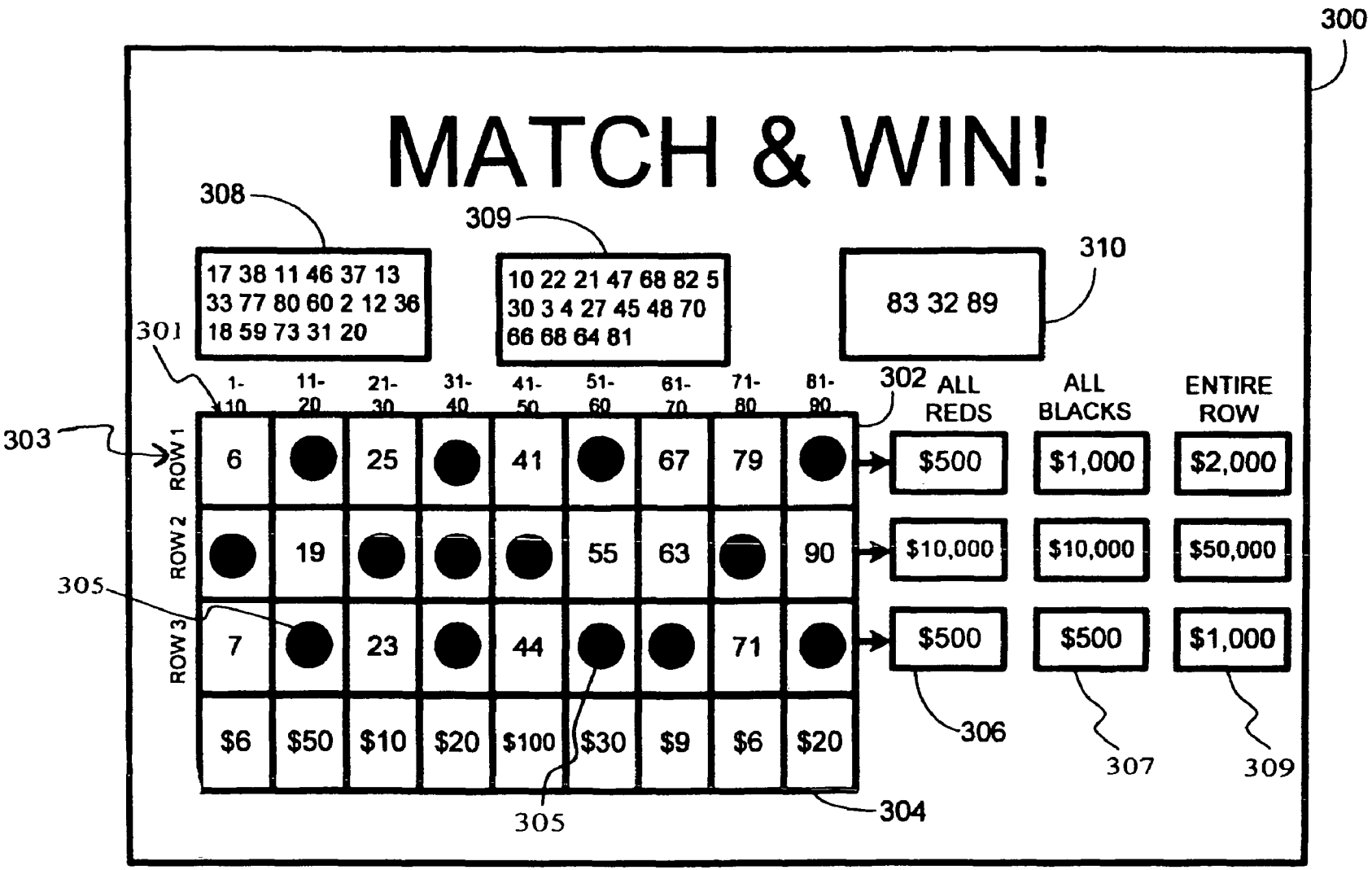
FIG. 4 illustrates the scratch-off game card of FIG. 3 with game indicia and player indicia revealed.

FIG. 4 illustrates the game card 300 with the player indicia and bonus indicia revealed. The game indicia that match player indicia are illustrated with circles 305. Circles 305 may have one or more colors and may be transparent or translucent. The game indicia, such as indicia 32, that match bonus indicia are also marked with a circle 305. As shown, the game indicia in column "31-40" are marked with circles 305 indicating that the player has won $20 associated with that column. If game indicia 79 (in column 301 with label "71-80" had matched to a player indicium in player indicia group 308 or bonus indicia 310, the player would also win a prize of $500 for having matched all red game indicia of row 1.

Accordingly, in another exemplary embodiment, a lottery game card includes a substrate, a game indicia area, and a player indicia area. The game indicia area includes a plurality of game indicia and the plurality of game indicia are separated into a plurality of groups, each group being identified by a group identifier. There player indicia area includes a plurality of player indicia and the plurality of player indicia are separated into a plurality of groups, each group being identified by the group identifier. If the game indicia of a predefined pattern are matched to the player indicia, then the player wins a prize associated with the predefined pattern.

Although preferred embodiments of the invention have been disclosed in the foregoing specification, it will be understood by those skilled in the art using the teachings disclosed herein that many modifications and other embodiments are within the scope of the present invention.

What is claimed is:

1. A game card having a top, bottom, left, and right, the card including:

a substrate;

a player indicia area located upon said substrate, said player indicia area including a plurality of player indicia;

a game indicia area located upon said substrate, said game indicia area having a plurality of game indicia, wherein said plurality of game indicia are arranged into a matrix of columns and rows; and each said column having a column prize indicia identified on said substrate with means for identifying a prize to be won by a player matching all game indicia in said respective column with said player indicia;

each said row having a row prize indicia identified on said substrate with means for identifying a prize to be won by a player for matching all or a predetermined portion of said game indicia along said respective row with said player indicia; and wherein said player indicia and said game indicia are defined on said substrate such that multiple column and row prizes are awarded for satisfying matches for: a) multiple column prize indicia; b) multiple row prize indicia; or c) at least one column prize indicia and at least one row prize indicia; and further comprising means for distinguishing winning patterns of said game indicia in said rows that is less than all of said game indicia in said rows, wherein said distinguishing means comprises different color identifiers for alternating game indicia in said rows, said row prize indicia identifying a winning color pattern of game indicia within each respective row.

2. A game card as in claim 1, further comprising a bonus indicia area located upon said substrate, said bonus indicia area including a plurality of bonus indicia.

3. A game card as in claim 1, wherein said player indicia are concealed under a removable coating applied to said substrate.

4. A game card as in claim 1, wherein said game card in a lottery game card.

5. A game card as in claim 1, wherein alternating said columns within said matrix are assigned respective different alternating colors such that all game indicia within a column have the same color and adjacent said columns have different colors.

6. A game card as in claim 5, wherein said row prize indicia comprises a first, second, and third row prize indicia identified with each said row, wherein said first row prize indicia identifies the prize to be won by a player matching all of said game indicia in said row having a first game indicia color, said second row prize indicia identifies the prize to be won by a player matching all of said game indicia in said row having a second game indicia color, and said third row prize indicia identifies the prize to be won by a player matching all of said game indicia in said row with said player indicia.

* * * * *